US008599120B2

(12) United States Patent
Kanou

(10) Patent No.: US 8,599,120 B2
(45) Date of Patent: Dec. 3, 2013

(54) TIMING CONTROLLER, LIQUID CRYSTAL DISPLAY DEVICE HAVING THE TIMING CONTROLLER AND METHOD OF DRIVING THE LCD DEVICE

(75) Inventor: Hideki Kanou, Tokyo (JP)

(73) Assignee: Lapis Semiconductor Co., Ltd., Yokohama (JP)

( * ) Notice: Subject to any disclaimer, the term of this patent is extended or adjusted under 35 U.S.C. 154(b) by 975 days.

(21) Appl. No.: 12/073,154

(22) Filed: Feb. 29, 2008

(65) Prior Publication Data

US 2008/0238845 A1 Oct. 2, 2008

(30) Foreign Application Priority Data

Mar. 28, 2007 (JP) ..... 2007-085134

(51) Int. Cl.
*G09G 3/36* (2006.01)
*G09G 5/02* (2006.01)

(52) U.S. Cl.
USPC ..... 345/87; 345/604

(58) Field of Classification Search
USPC ..... 345/1.1, 1.2, 87–105, 601–605, 589, 345/600; 358/1.9, 500
See application file for complete search history.

(56) References Cited

U.S. PATENT DOCUMENTS

| | | | | |
|---|---|---|---|---|
| 5,331,439 | A * | 7/1994 | Bachar | 358/500 |
| 7,304,623 | B2 * | 12/2007 | Tomizawa et al. | 345/88 |
| 7,460,269 | B2 * | 12/2008 | Sato | 358/1.9 |
| 7,782,283 | B2 * | 8/2010 | Hong et al. | 345/88 |
| 7,868,862 | B2 * | 1/2011 | Lee et al. | 345/88 |
| 7,969,448 | B2 * | 6/2011 | Yang et al. | 345/589 |
| 2003/0034943 | A1 * | 2/2003 | Takeda | 345/87 |
| 2004/0183813 | A1 * | 9/2004 | Edge | 345/600 |

FOREIGN PATENT DOCUMENTS

| | | | |
|---|---|---|---|
| JP | 2006-317899 | A | 11/2006 |
| WO | WO 2005050296 | A1 * | 6/2005 |

* cited by examiner

*Primary Examiner* — Chanh Nguyen
*Assistant Examiner* — James Nokham
(74) *Attorney, Agent, or Firm* — Rabin & Berdo, P.C.

(57) ABSTRACT

An LCD device includes a display panel having a plurality of pixels on which an image is displayed and a timing controller, which includes a receiver receiving image data in series for displaying the image on the display panel wherein the image data being made up of pixel data of three prime colors that are Red, Green and Blue for each pixel, a serial/parallel converter sorting the image data received at the receiver in the order that the display panel can display the image, a sub-pixel generator generating complementary color image data, which are image data of the complementary color indicating the image indicated by the sorted image data, based on information of the sorted image data, and a transmitter transmitting the sorted image data and the complementary color image data.

17 Claims, 7 Drawing Sheets

TIMING CONTROLLER, LIQUID CRYSTAL DISPLAY DEVICE HAVING THE TIMING CONTROLLER AND METHOD OF DRIVING THE LCD DEVICE

CROSS-REFERENCE TO RELATED APPLICATION

This application claims the priority benefit of Japanese Patent Application No. 2007-085134, filed Mar. 28, 2007, the entire disclosure of which is incorporated herein by reference.

BACKGROUND OF THE INVENTION

1. Field of the Invention

The invention relates to a timing controller, a liquid crystal display device and a method for driving the LCD device, specifically relates to a timing controller used in the liquid crystal display device and a method for driving the liquid crystal display having the timing controller.

2. Description of the Related Art

A general liquid crystal display device includes a plurality of pixels, each of which includes three sub-pixels having three primary colors, such as Red (R), Green (G) and Blue (B), respectively, in order to display multiple colors. The information as to the color to be displayed is transformed into a gradation signal of R, G and B in response to a luminance signal and a color-difference signal, and the gradation signal is then inputted to a timing controller. The gradation signal sent to the timing controller is sorted in order to display the image at a display panel, and the sorted gradation signal is sent to a driver, which is disposed on the display panel, for driving the display panel. The timing controller also generates other timing data necessary to display the image at the display panel.

Basically, displaying a specific color is performed by a combination of the three primary colors, which are R, G and B. Thus, the scope of the color to be displayed in accordance with the combination of the three primary colors is limited within a scope of the triangle (color-reproduction <color-space> area) as shown in FIG. 6 whose vertexes are R, G and B, respectively, However, in order to display the highly-pure color, it is necessary to add complementary colors, such as Yellow (Y) as shown in FIG. 7 and the others.

According to the Japanese laid open patent publication JP 2006-317899A, it is disclosed that a conventional liquid crystal display device includes a liquid crystal panel having 4-color sub-pixels, a data driver providing video data signals to each sub-pixel, a gate driver 106 providing a scan pulse to each sub-pixel, a data converter generating a gain value by analyzing a ratio of an achromatic color signal to a chromatic color signal of 3-color source data inputted from an external source and converting the 3-color source data into 4-color data using the generated gain value and a timing controller providing the 4-color data received from the data converter to the data driver and controlling the gate driver and the data driver.

However, according to the conventional liquid crystal display device described in the reference, since the 4-color data having the complementary color data are generated in the data converter, which is disposed in the previous stage of (in the upstream of) the timing controller, the large encumbrance hangs to the liquid crystal display device as a whole.

When a general liquid crystal display device displays a specific color image, three primary colors of R, G, and B are used for the processes for displaying the image, which are performed by a color imaging device, such as CCDs (Charge Couple devices) or CMOSs (Complementary Metal Oxide Devices). By adding the complementary color data on the 3-color data, the load for the processors in the liquid crystal display device or connection cables is increased.

When the general liquid crystal display device employs the technology disclosed in the reference, the following problems may occur. FIG. 8 is a conceptual diagram of a liquid crystal display device in the related art, which employs the technology disclosed in the reference.

The liquid crystal display device 200 includes a graphic processor 220 in which the data converter 221 disclosed in the reference is incorporated. The complementary color data (the Y data) is generated in the graphic processor 220 so that the load for the graphic processor 220 or a connection cable between the graphic processor 220 and a timing controller 230 is increased because the complementary color data (the Y data) is added. For example, when the Y data is added as the complementary color data, the volume of the data processed in the graphic processor 220 is increased by four thirds (4/3), and this increased volume of the data increases the load of the LSIs and the cables used in the liquid crystal display device 200.

In the liquid crystal display device 200, the R data, the G data, the B data and the Y data are generated in the graphic processor 220, and all data are transmitted to the timing controller 230 in the form of a low amplitude differential signal. Such data are generally transmitted by LVDS (Low Voltage Differential Signaling) system (or other Internal Panel Interface). In the case that 3 color data (the R data, the G data and the B data) are used, twenty four (24) signal lines (=12 lines×2) are required under the condition that the each of the data has 10 bits and clock signals are divided by odd and even. However, when the Y data are added, around thirty (30) through thirty two (32) signal lines are required. Otherwise, the data transmitting frequency should be increased by four thirds (4/3).

SUMMARY OF THE INVENTION

An objective of the invention is to solve the above-described problem and to provide a liquid crystal display device having a timing controller, which suppresses the increased load in the display device as a whole, which is caused by newly generating complementary color data.

The objective is achieved by a liquid crystal display device including a liquid crystal display panel having a plurality of pixels on which an image is displayed and a timing controller, which includes a receiver, which receives image data in series for displaying the image on the liquid crystal display panel, the image data being made up of pixel data of three prime colors that are Red, Green and Blue for each pixel, a converter sorting the image data received at the receiver in the order that the liquid crystal display panel can display the image, a generator generating complementary color image data, which are image data of the complementary color indicating the images indicated by the sorted image data, based on information of the sorted image data, and a transmitter transmitting the sorted image data and the complementary color image data.

BRIEF DESCRIPTION OF THE DRAWINGS

The invention will be more particularly described with reference to the accompanying drawings, in which.

DETAILED DESCRIPTION OF THE PREFERRED EMBODIMENTS

The preferred embodiment of the invention as to a liquid crystal display device is explained together with drawings as follows. In each drawing, the same reference numbers designate the same or similar components.

The Preferred Embodiment

Figure 1:
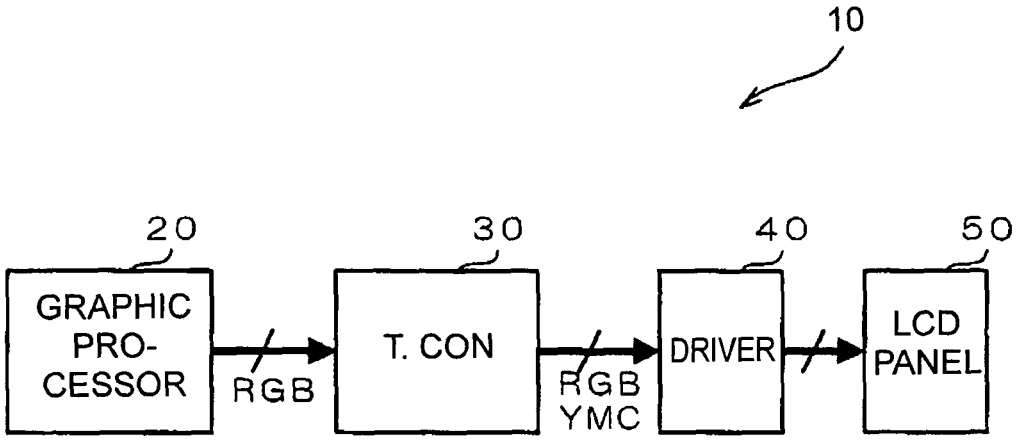
FIG. 1 is a block diagram of a liquid crystal display device, according to a preferred embodiment.

FIG. 1 is a block diagram of a liquid crystal display device 10, according to a preferred embodiment. As shown in FIG. 1, the liquid crystal display device 10 includes a liquid crystal display panel 50, which includes a plurality of pixels, for displaying images. In the preferred embodiment, although the liquid crystal display panel 50 employs a TFT active matrix system, a STN passive matrix system or a DSTN or a FSTN passive matrix system may be employed.

The liquid crystal display device 10 further includes a graphic processor 20. The graphic processor 20 generates image data, which indicates an image to be displayed and are made up of pixel data of three prime colors (Red, Green and Blue) for each pixel. The graphic processor 20 of the preferred embodiment transmits the image data in series.

The liquid crystal display device 10 further includes a timing controller 30 having an input terminal, which is connected to the graphic processor 20 at its output terminal from which the image data are transmitted. The timing controller 30 sorts the image data transmitted from the graphic processor 20 in order to display the image on the liquid crystal display panel 50 based on the image data. Based on the information of the sorted image data, the timing controller 30 generates complementary color image data, which is image data of the complementary color indicating the images indicated by the sorted image data. The timing controller 30 also generates other data necessary to display the image at the display panel 50.

The transmittance of the image data from the graphic processor 20 to the timing controller 30 is performed in the LVDS system (or other Internal Panel Interface).

The liquid crystal display device 10 further includes a driver 40 having an input terminal, which is connected to the timing controller at its output terminal from which the sorted image data and the complementary color image data are transmitted. The driver drives the display panel 50 in order to display the image by using the sorted image data and the complementary color image data.

Figure 2:
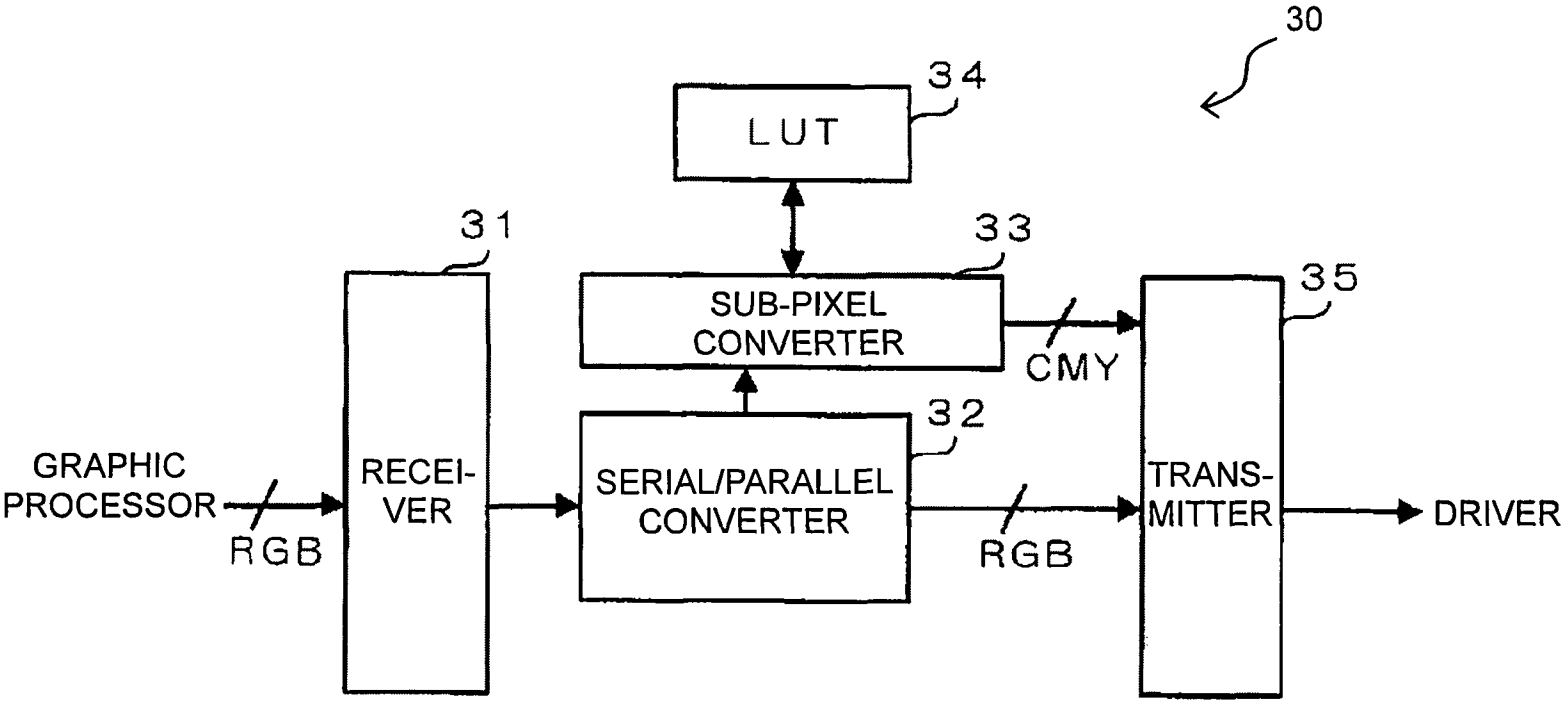
FIG. 2 is a typical block diagram of a timing controller used in the liquid crystal display device shown in FIG. 1.

The detail function and the structures of the timing controller 30 are explained as follows with reference to FIG. 2. FIG. 2 is a block diagram of a timing controller used in the liquid crystal display device shown in FIG. 1.

As shown in FIG. 2, the timing controller 30 includes a receiver 31, a serial/parallel converter 32, a sub-pixel generator 33, a look-up table (herein after it is called a LUT) 34 and the transmitter 35. The receiver 31 includes an input terminal, which is connected to the output terminal of the graphic processor 20 from which the image data are transmitted. The receiver 31 boosts the image data, which are transmitted in the LVDS system, to the logical voltage level.

The serial/parallel converter 32 includes an input terminal, which is connected to an output terminal of the receiver 31 from which the boosted image data are transmitted. The serial/parallel converter 32 generates the sorted image data by sorting the boosted image data transmitted from the receiver 31 in order to display the image at the display panel 50.

The sub-pixel generator 33 includes an input terminal, which is connected to an output terminal of the serial/parallel converter 32 from which the sorted image data are transmitted. The sub-pixel generator 33 generates the complementary color image data based on the sorted image data transmitted from the serial/parallel converter 32.

The LUT 34, which is connected to the sub-pixel generator 33, stores correction factors, which is used for correcting the complementary color image data depending on the characteristics of the display panel 50, when the complementary color image data is generated at the sub-pixel generator 33. The characteristics of the display panel 50 include the color filtering characteristics and the wavelength characteristics of the back light disposed in the display panel 50. The timing controller 30 can be used for few kinds of display panels so that the LUT 34 stores the correction factors depending on each display panel.

The sub-pixel generator 33 obtains the correction factors depending on the characteristics of the display panel 50, which is used in the preferred embodiment, from the LUT 34, and then generates the corrected complementary color image data by using the readout correction factors. In the preferred embodiment, although the LUT 34 employs an EEPROM, a ROM or a non-volatile memory may be employed. When a non-volatile memory is employed, data as to the correction factors should be written therein.

The transmitter 35 includes two input terminals, one of which is connected to an output terminal of the sub-pixel generator 33 from which the complementary color image data are transmitted, and another of which is connected to an output terminal of the serial/parallel converter 32 from which the sorted image data are transmitted. The transmitter 35 of the preferred embodiment transforms the sorted image data and the complementary color image data into the format such as RSDS (reduced Swing Differential Signaling) or mini-LVDS, which can be recognized by the driver 40, and then transmits the transformed data to the driver 40.

Figure 3:
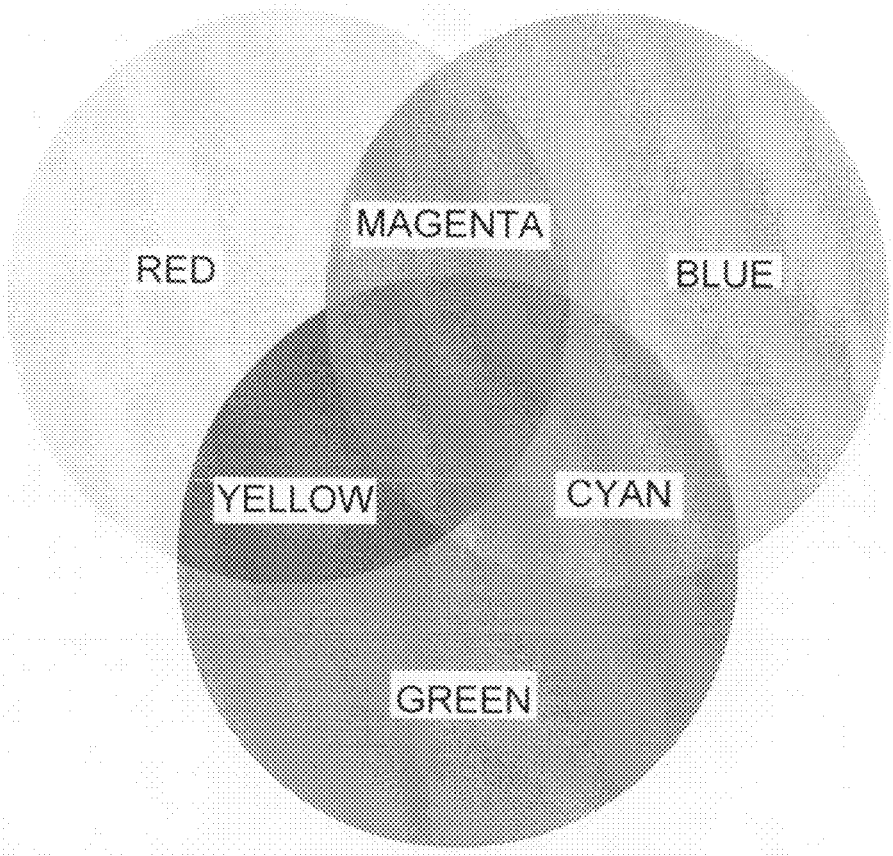
FIG. 3 is a color relationship diagram in the additive color mixture.

The complementary color image data are generated by the sub-pixel generator 33 in the following process. The process is explained below with reference to FIG. 3. FIG. 3 is a color relationship diagram in the additive color mixture.

As shown in FIG. 3, the Y data can be generated by Red and Green. Generally, the color data are represented by eight bits (256 levels) in the liquid crystal display device, and pure Yellow is defined by (R=255, G=255, B=0). The Y data can be simply calculated by the following equation (1).

$$Y = \frac{(R + G + k)}{2} \tag{1}$$

where "k" is the correction factor of Yellow corresponding to the display panel 50 being used, which is stored in the LUT 34.

As well, the C (Cyan) data can calculated by the following equation (2), and the M (Magenta) data can be calculated by the following equation (3).

$$C = \frac{(G + B + k')}{2} \tag{2}$$

$$M = \frac{(R + B + k'')}{2} \tag{3}$$

where "k'" is the correction factor of Cyan corresponding to the display panel 50 being used, which is stored in the LUT 34, and where "k"" is the correction factor of Magenta corresponding to the display panel 50 being used, which is stored in the LUT 34.

The sub-pixel generator 33 substitutes the sorted image data transmitted from the serial/parallel converter 32 into the equations (1)~(3) for each pixel, and substitutes the correction factors of Yellow, Cyan and Magenta corresponding to the display panel 50 being used into the equations (1)~(3). As a result of the calculation, the image data corresponding to each complementary color (Yellow, Cyan and Magenta) are generated.

Figure 4:
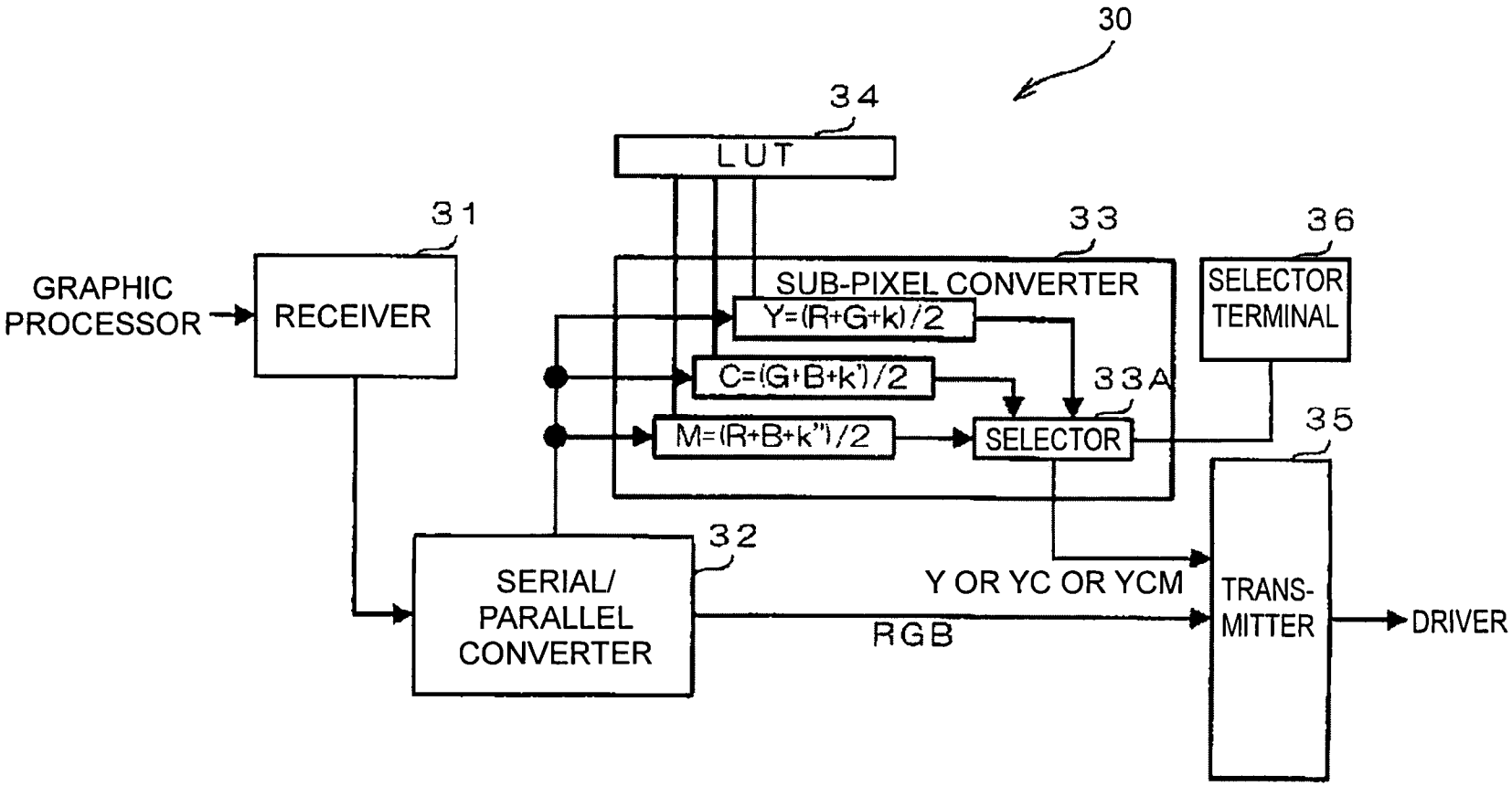
FIG. 4 is a block diagram of a sub-pixel generator used in the timing controller shown in FIG. 2.

FIG. 4 is a block diagram of the sub-pixel generator 33 used in the timing controller shown in FIG. 2. As shown in FIG. 4, while the sub-pixel generator 33 includes a selector 33A, a selector terminal 36 for setting the kind of the display panel being used is formed outside the timing controller 30. Thus, in response to the settings inputted from the selector terminal 36, the complementary color image data to be transmitted to the transmitter 35 can be selected by the selector 33A.

The timing controller 30 is capable to four (4) kinds of the display panels, such as the display panel, which displays an image by the primary colors (Red, Green and Blue), the display panel, which displays the image by the four colors (Red, Green, Blue and Yellow), the display panel, which displays the image by the five colors (Red, Green, Blue, Yellow and Cyan), and the display panel, which displays the image by the six colors (Red, Green, Blue, Yellow, Cyan and Magenta).

Figure 5:
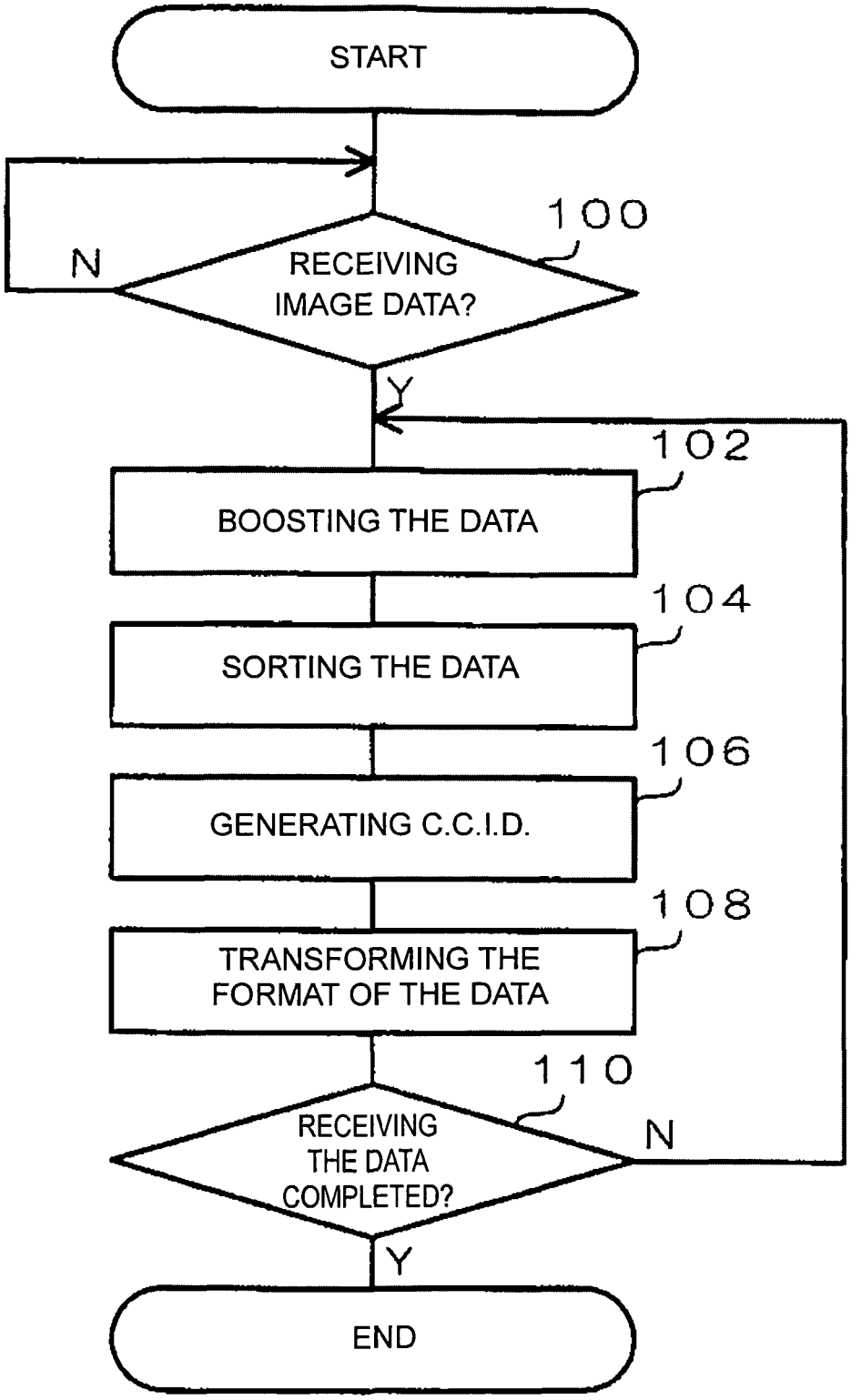
FIG. 5 is a flow chart of processes performed in the in the timing controller shown in FIG. 2.
Figure 6:
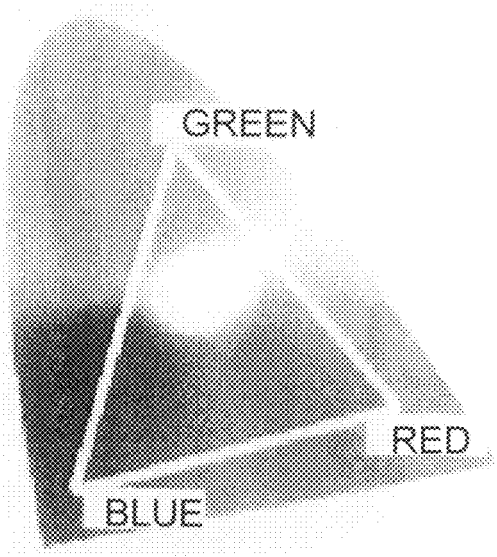
FIG. 6 is a chromaticity diagram (CIE1931 chromaticity diagram) showing the scope of the color to be displayed in accordance with the combination of the three primary colors.
Figure 7:
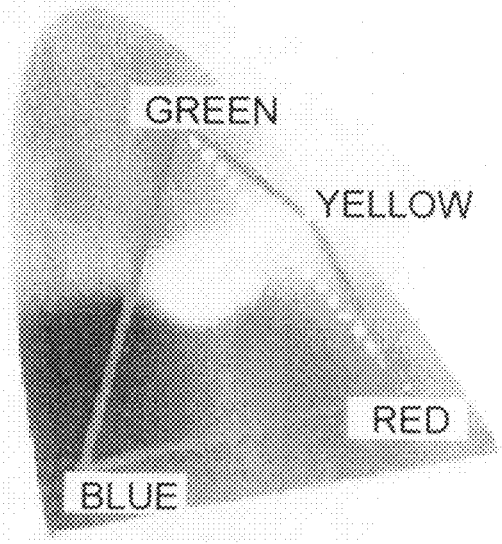
FIG. 7 is a chromaticity diagram showing the scope of the color to be displayed in accordance with the combination of the three primary colors with one complementary color (Yellow)
Figure 8:
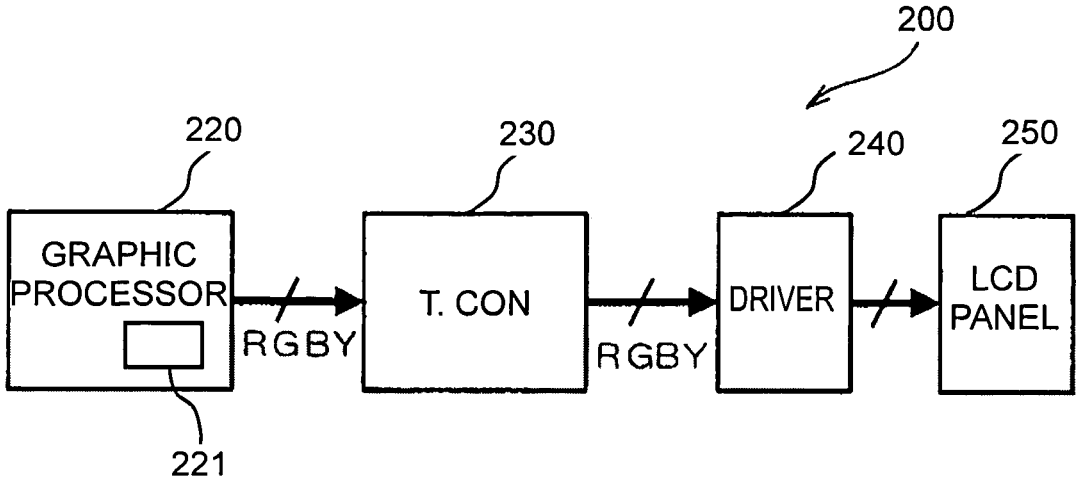
FIG. 8 is a block diagram of a liquid crystal display device in the related art.

The operation of the timing controller 30 is explained below with reference to FIG. 5. FIG. 5 is a flow chart of processes performed in the in the timing controller 30 shown in FIG. 2. In the following explanation, to avoid the confusion, the display panel 50 is selected as the display panel being used in response to the setting inputted from the selector terminal 36.

In the Step 100, the timing controller 30 waits for the image data being transmitted from the graphic processor 20, at its receiver 31. In the Step 102, the image data, which are transmitted in the LVDS system, are boosted to the logical voltage level by the receiver 31. In the Step 104, the sorted image data are generated by sorting the boosted image data at the serial/parallel converter 32 in order to display the image at the display panel 50.

In the Step 106, the complementary color image data are generated by the sub-pixel generator 33 in response to the sorted image data. Here, the sub-pixel generator 33 obtains the correction factor from the LUT 34, which corresponds to the characteristics of the display panel 50 being used, and then generates the complementary color image data by substituting the correction factor into the equations (1)~(3). Then, the complementary color image data, which are used for the display panel 50 being used, is only selected by the selector 33A, and then, the selected complementary color image data are outputted to the transmitter 35.

In the Step 108, the transmitter 35 transforms the sorted image data transmitted from the serial/parallel converter 32 and the complementary color image data transmitted from the sub-pixel generator 33 into the format, which can be recognized by the driver 40, and then transmits the transformed data to the driver 40.

In the timing controller of the preferred embodiment, the process in the Steps 102~108 are performed by the predestined unit of the pixels in real-time. So, in the Step 110, it is judged whether or not the process for receiving all image data transmitted from the graphic processor 20 is completed. If the answer of the step 110 is "NO", the Step 102 is repeated, and the answer of the step 110 is "YES", the process is terminated.

According to the liquid crystal display device 10 of the preferred embodiment, since the complementary color image data is generated by the timing controller 30, it is possible to suppress the load as a whole of the liquid crystal display device, which is caused by newly generating data for the complementary color, compared with the case that the complementary color image data is generated by any circuits, which is located in the previous stage of (in the upstream of) the timing controller, such as in the graphic processor 20.

Furthermore, according to the liquid crystal display device 10, since the complementary color is at least one of Yellow, Cyan and Magenta, the image data of the color being applied as the complementary color image data can be generated. Moreover, since the complementary color image data are generated as the corrected data by using the correction factors, which are used for correcting the complementary color image data in response to the characteristics of the display panel 50 being used, the complementary color image data, which are suitable for the particular display panel being used, can be generated.

In addition, according to the method of driving the LCD device, the natural graduation can be obtained because of getting the addition half tone colors.

While the invention has been described with reference to illustrative embodiment, this description is not intended to be construed in a limiting sense. Thus, shapes, size and physical relationship of each component are roughly illustrated so the scope of the invention should not be construed to be limited to them. Further, to clarify the components of the invention, hatching is partially omitted in the cross-sectional views. Moreover, the numerical description in the embodiment described above is one of the preferred examples in the preferred embodiment so that the scope of the invention should not be construed to limit to them.

For example, although generating the complementary color image data is performed by the hardware, it is possible to generate the complementary color image data by software. In this case, the flowchart shown in FIG. 5 is performed by a computer with the computer readable program. When the processes shown in the flowchart of the FIG. 5 are performed by the software, the cost for manufacturing the device can be lowered. The computer can be incorporated in the timing controller 30.

Further, in the preferred embodiment, the complementary color image data are generated in the sub-pixel generator 33, based on the sorted image data transmitted from the serial/parallel converter 32. However, based on the image data, which are not yet sorted by the serial/parallel converter 32, the complementary color image data can be generated. The same benefit can be expected in both cases.

Various other modifications of the illustrated embodiment will be apparent to those skilled in the art on reference to this description. Therefore, the appended claims are intended to cover any such modifications or embodiments as fall within the true scope of the invention.

What I claim is:

1. A liquid crystal display device, comprising:

a liquid crystal display panel having a plurality of pixels on which an image is displayed;

a graphic processor transmitting image data, including pixel data, that corresponds only to the three primary colors red, green, and blue for each pixel; and a timing controller, separate from the graphic processor, including a receiver, which receives the transmitted image data from the graphic processor in series for displaying the image on the liquid crystal display panel, a serial/parallel converter sorting the image data received at the receiver in the order that the liquid crystal display panel displays the image, a memory storing correction factors that correspond to characteristics of liquid crystal display panels, a group of the correction factors corresponding to characteristics of the liquid crystal display panel of the liquid crystal display device, a generator generating complementary color image data based on information of the sorted image data and said group of correction factors, the complementary color image data being image data of complementary color corresponding to the image indicated by the sorted image data, a selector for selecting part of the complementary color image data based upon the characteristics of the liquid crystal display panel of the liquid crystal display device, and transmitting the selected part of the complementary color image data, and a transmitter receiving the selected part of the complementary color image data from the selector, and transmitting the sorted image data and the selected part of the complementary color image data.

2. A liquid crystal display device as claimed in claim 1, wherein the complementary color is at least one of Yellow, Cyan and Magenta.

3. A liquid crystal display device as claimed in claim 1, wherein the graphic processor generates the image data to be sent to the receiver of the timing controller, the liquid crystal display device further comprising a driver receiving the sorted image data and the selected part of the complementary color image data, which are both transmitted from the transmitter, and driving the liquid crystal display panel to display the image by using the sorted image data and the selected part of the complementary color image data.

4. A liquid crystal display device as claimed in claim 3, wherein the timing controller controls the driver to drive the liquid crystal display panel to display the image.

5. A liquid crystal display device as claimed in claim 1, wherein the liquid crystal display panel displays the primary colors red, green and blue and the complementary color which is indicated by the selected part of the complementary color image data.

6. A timing controller as claimed in claim 1, wherein the liquid crystal display panel displays the primary colors red, green and blue and the complementary color which is indicated by the selected part of the complementary color image data.

7. A liquid crystal display device as claimed in claim 1, wherein the timing controller generates timing data used for displaying the image on the liquid crystal display panel.

8. A liquid crystal display device as recited in claim 1, wherein the generator outputs only the complementary color image data which represents one or more of yellow, cyan and magenta.

9. A liquid crystal display device as recited in claim 1, wherein the generator generates each color of the complementary color image data based upon a combination of two of the three primary colors and one of the correction factors of said group of correction factors.

10. A method of driving a liquid crystal display device having a liquid crystal display panel, comprising:

generating image data for an image to be displayed on the liquid crystal display panel by a graphic processor, the image data being made up of pixel data of only the three primary colors red, green and blue for each pixel of the liquid crystal display panel;

transmitting the image data in series to a receiver of a timing controller that is separate from the graphic processor;

sorting the received image data by a serial/parallel converter in the timing controller in the order that the liquid crystal display panel displays the image;

determining, from a memory that stores correction factors that correspond to characteristics of liquid crystal display panels, a group of the correction factors corresponding to characteristics of the liquid crystal display panel of the liquid crystal display device;

generating complementary color image data by a generator in the timing controller based on information of the sorted image data and said group of correction factors, the complementary color image data being image data of complementary color corresponding to the image indicated by the sorted image data;

selecting, by a selector in the timing controller, part of the complementary color image data based upon the characteristics of the liquid crystal display panel of the liquid crystal display device;

transmitting the sorted image data and the selected part of the complementary color image data to a driver; and driving, by the driver, the liquid crystal display panel to display the image by using the transmitted sorted image data and the transmitted selected part of the complementary color image data.

11. The method of claim 10, wherein the step of driving further includes controlling, by the timing controller, the driver to drive the liquid crystal display panel.

12. The method of claim 10, further comprising:

generating timing data by the timing controller; and during the step of driving, applying the timing data to control the driver to display the image on the liquid crystal display panel.

13. A timing controller, separate from a graphic processor, used for a liquid crystal display device, comprising:

a receiver, which receives image data from the graphic processor, the image data being received in series for displaying an image on a liquid crystal display panel of the liquid crystal display device, the image data being made up of pixel data of only the three primary colors red, green and blue for each pixel, a serial/parallel converter sorting the image data received at the receiver in the order that the liquid crystal display panel displays the image, a memory storing correction factors that correspond to characteristics of liquid crystal display panels, a group of the correction factors corresponding to characteristics of the liquid crystal display panel of the liquid crystal display device, a generator generating complementary color image data based on information of the sorted image data and said group of correction factors, the complementary color image data being image data of complementary color corresponding to the image indicated by the sorted image data, a selector for selecting part of the complementary color image data based upon the characteristics of the liquid crystal display panel of the liquid crystal display device, and transmitting the selected part of the complementary color image data, and a transmitter receiving the selected part of the complementary color image data from the selector, and transmitting the sorted image data and the selected part of the complementary color image data.

14. A timing controller as claimed in claim 13, wherein the complementary color is at least one of yellow, cyan and magenta.

15. A timing controller as claimed in claim 13, further wherein the graphic processor generates the image data to be sent to the receiver of the timing controller, and a driver receives the sorted image data and the selected part of the complementary color image data, which are both transmitted from the transmitter, and driving the liquid crystal display panel to display the image by using the sorted image data and the selected part of the complementary color image data.

16. A timing controller as claimed in claim 15, wherein the timing controller controls the driver to drive the liquid crystal display panel to display the image.

17. A timing controller as claimed in claim 13, wherein the timing controller generates timing data used for displaying the image on the liquid crystal display panel.

* * * * *